US006050362A

United States Patent [19]

Feijen

[11] Patent Number: 6,050,362

[45] Date of Patent: Apr. 18, 2000

[54] EXHAUST SYSTEM WITH SEAMED ROLL JOINTS AND METHOD FOR MANUFACTURE

[75] Inventor: Henricus Johannes Gerhardus Maria Feijen, Roermond, Netherlands

[73] Assignee: Arvin Exhaust B.V., Roermond, Netherlands

[21] Appl. No.: 09/098,413

[22] Filed: Jun. 16, 1998

[30] Foreign Application Priority Data

Jun. 16, 1997 [NL] Netherlands ..... 1006333

[51] Int. Cl.[7] ..... F01N 7/02

[52] U.S. Cl. ..... 181/232; 181/282; 181/255

[58] Field of Search ..... 181/232, 227, 181/228, 269, 272, 282, 255

[56] References Cited

U.S. PATENT DOCUMENTS

| | | | |
|---|---|---|---|
| 3,381,774 | 5/1968 | Stade et al. . | |
| 3,807,527 | 4/1974 | Bergson et al. | 181/232 |
| 4,547,942 | 10/1985 | Fukuda . | |
| 5,245,140 | 9/1993 | Wu | 181/232 |
| 5,559,308 | 9/1996 | Hayashi . | |

FOREIGN PATENT DOCUMENTS

| | | |
|---|---|---|
| 59030183 | 9/1985 | European Pat. Off. . |
| 0 252 373 | 1/1988 | European Pat. Off. . |
| 1060334 | 4/1954 | France . |
| 2 457 969 | 12/1980 | France . |
| 195 14 829 | 10/1995 | Germany . |

*Primary Examiner*—Khanh Dang
*Attorney, Agent, or Firm*—Young & Thompson

[57] ABSTRACT

An exhaust system structure and method comprising two or more silencers which are placed in series and are each provided with a tubular section, the edges of which are in each case attached to a transverse plate which marks the end of the section in question, and each tubular section is provided with sound-damping internal parts, two tubular sections with different cross-sections being mounted one behind the other, making use of a transverse plate, the external dimensions of which are related to the cross-sectional dimensions of the tubular section with the largest cross-section and provided with an opening, the dimensions of which are related to the cross-sectional dimensions of the tubular section with the smallest cross-section, in which exhaust system the transverse plate is attached to the edges of the two tubular sections by means of seamed roll joints.

13 Claims, 4 Drawing Sheets

FIG. 6A
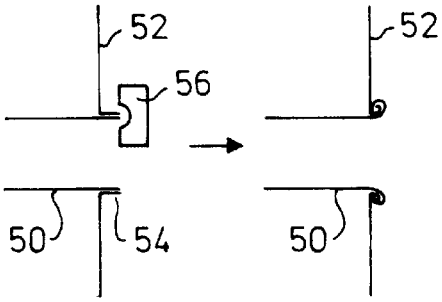
FIG. 6B
FIG. 6C
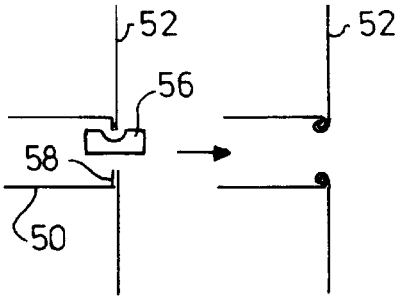
FIG. 6D

EXHAUST SYSTEM WITH SEAMED ROLL JOINTS AND METHOD FOR MANUFACTURE

BACKGROUND OF THE INVENTION

1. Field of the Invention

The invention relates to an exhaust system structure and method for manufacture comprising two or more silencers which are placed in series and are each provided with a tubular section, the edges of which are in each case attached to a transverse plate which marks the end of the section in question, and each tubular section is provided with sound-damping internal parts. Two tubular sections with different cross-sections are mounted one behind the other, making use of a transverse plate, the external dimensions of which are related to the cross-sectional dimensions of the tubular section with the largest cross-section. The transverse plate is provided with an opening, the dimensions of which are related to the cross-sectional dimensions of the tubular section with the smallest cross-section.

2. Description of the Related Art

An exhaust system of this kind is known from German Laid-open Specification DE 19514829 A1. The exhaust system described in that document is intended to be used in a motorcycle and comprises a cylindrical section with a relatively large cross-section, in which sound-damping internal parts are arranged, and a cylindrical section with a relatively small cross-section, in which sound-damping internal parts are also arranged. The two sections are connected to one another via a transverse plate which is attached to the edges of the two sections by means of welding or soldering. In order to be adapted to the space available, the transverse plate is not planar but rather shaped so as to be able to accommodate the entire combination within the desired space.

Forming joints between various sections and the transverse plates employed by means of welding or soldering is regarded as disadvantageous. If welded or soldered joints are to be used, it is necessary for the plate materials employed to have a certain minimum thickness in order, on the one hand, to minimize the occurrence of mechanical stresses and deformations in the system and, on the other hand, to avoid the parts to be welded (soldered) simply burning away and consequently not being welded.

It should be noted that various publications are already known from the prior art in which use is made of seamed roll joints at similar locations.

U.S. Pat. No. 5,559,308 describes a single silencer provided with a tubular section which is closed off at both ends by a transverse plate. The transverse plates are attached to the tube section by means of seamed roll joints. A pipe stub to which further pipes can be connected is mounted in each of the transverse plates by means of an S-shaped deformation of the plate. This document deals with a single silencer, not with a combination of two or more silencers.

FR 2,457,969 describes a structure in which the outer edge of a transverse plate is fixed to the edge of a tubular section by means of seamed roll joints, while a pipe is fixed in an opening in the transverse plate by means of a so-called ridge lock connection. A ridge lock connection is less durable than a real seamed roll joint. Furthermore, this is clearly not a combination of two silencers.

EP 0,252,373 describes a single silencer provided with a tubular section which is closed off at both ends by a transverse plate. The transverse plates are attached to the tube section by means of seamed roll joints. A pipe is fitted in each of the transverse plates by means of a ridge lock connection. This document again deals with a single silencer, and not with a combination of two or more silencers.

SUMMARY OF THE INVENTION

Therefore, one object of the invention is to produce exhaust systems in which the use of welded joints, at least with regard to the exterior, is limited as far as possible. A further object of the invention is to make exhaust systems as compact as possible by eliminating connecting pipes between silencer sections as far as possible.

Exhaust systems which are as compact as possible are desirable not only for motorcycles, but also in the automobile industry, where it is desired to produce compact units which can be fitted within a relatively small space. As a result, an exhaust system comprises many fewer components and can be fitted much more easily. This aim is also served by designing exhaust systems which have as few connecting pieces as possible between the silencers.

A further object of the invention is therefore to produce exhaust systems in which silencers can be coupled directly to one another.

These objectives are met using a system of the type mentioned in the preamble by the fact that each transverse plate is attached to edges of the two tubular sections by means of seamed roll joints.

The term "tubular" has to be interpreted broadly within the context of the invention and includes tubes of any desired cross-sectional shapes. The term also includes tubes whose cross-sectional shape is different at both ends, for example tubes which change from round to oval or taper from large to small.

The invention is not limited to two tubular sections of different cross-sections which immediately follow one another, but may in principle be used for any desired succession of three or more tubular sections with different cross-sections. Here too, it is possible to produce all the joints by means of seamed roll joints.

The term "internal parts" is intended to mean an assembly of plates and tubes which defines a circuit through which the exhaust gases have to pass and in which the sound vibrations are damped. As an alternative to an assembly of this kind, it is also possible to use a catalytic converter as the internal parts.

Depending, inter alia, on the internal parts used, it may be desirable to close off the opening in the transverse plate using a perforated closure plate. An appropriate embodiment of the exhaust system is characterized in that a perforated closure plate, the external dimensions of which are related to the cross-sectional dimensions of the tubular section with the smallest cross-section, is provided for the purpose of delimiting the tubular section with the smallest cross-section. The perforated closure plate is situated approximately in the same plane as the transverse plate and is attached to the edge of the transverse plate or to the edge of the tubular section by means of seamed roll joints.

The term "perforated closure plate" is to be interpreted broadly as a plate which is provided with one or more openings, optionally of different shapes and sizes.

The invention relates not only to the exhaust system itself, but also to a number of methods for producing an exhaust system of this nature. Depending on whether it is intended for a tubular section with a relatively small diameter to be followed by a tubular section with a relatively large diameter, or the other way round, the sequence of method steps will differ to some extent.

A first method for producing an exhaust system according to the invention is characterized in that in order to mount a tubular section with a relatively small cross-section against a tubular section with a relatively large cross-section, the tube of the section with the relatively small cross-section must first be attached to the edge of the opening in the transverse plate by means of seamed roll joint and, if appropriate after placing internal parts in the tubular section with a relatively large cross-section, the outer edge of the transverse plate is attached to the tube of the section with a relatively large cross-section by means of seamed roll joints.

Another embodiment of a method for producing an exhaust system according to the invention is characterized in that before mounting a tubular section with a relatively large cross-section against a tubular section with a relatively small cross-section, the tube of the section with the relatively small cross-section must be first attached to the edge of the opening in the transverse plate by means of seamed roll joint and, if appropriate after placing internal parts in the section with a relatively small cross-section, the outer edge of the transverse plate is attached to the tube of the section with a relatively large cross-section by means of seamed roll joints.

If the equipment used to produce the seamed roll joints allows work to be carried out within the limited space formed by the tubular section with a relatively large cross-section, then a variant of the latter method is characterized in that before mounting a tubular section with a relatively large cross-section against a tubular section with a relatively small cross-section, the tube of the section with the relatively large cross-section is attached to the outer edge of the transverse plate by means of seamed roll joint and, if appropriate after placing internal parts in the tubular section with a relatively small cross-section, the edge of the opening in the transverse plate is attached to the tube of the section with a relatively small cross-section by means of seamed roll joints.

It is possible, within the context of all the methods described above, to provide a closure plate in order to close off the tubular section with a relatively small cross-section. In that case, the relevant method must be carried out in such a manner that, while the tube of the section with the relatively small cross-section is being attached to the edge of the opening in the transverse plate by means of seamed roll joints, a perforated closure plate is also attached by means of the same seamed rolling action.

BRIEF DESCRIPTION OF THE DRAWINGS

The invention will be described in more detail below with reference to the appended figures, in which:

FIGS. 6A–6D show alternatives for producing seamed roll joints.

DETAILED DESCRIPTION OF THE INVENTION

Figure 1A:
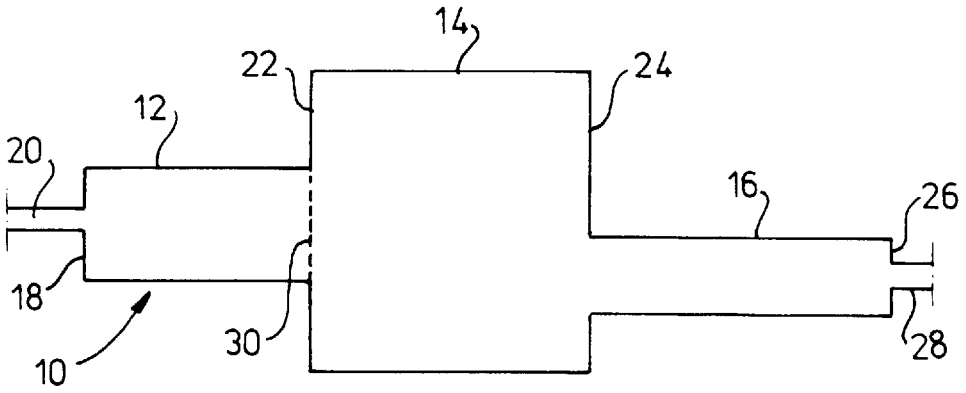
FIGS. 1A–1B show a general view of an exhaust system in which the invention may advantageously be employed.
Figure 1B:
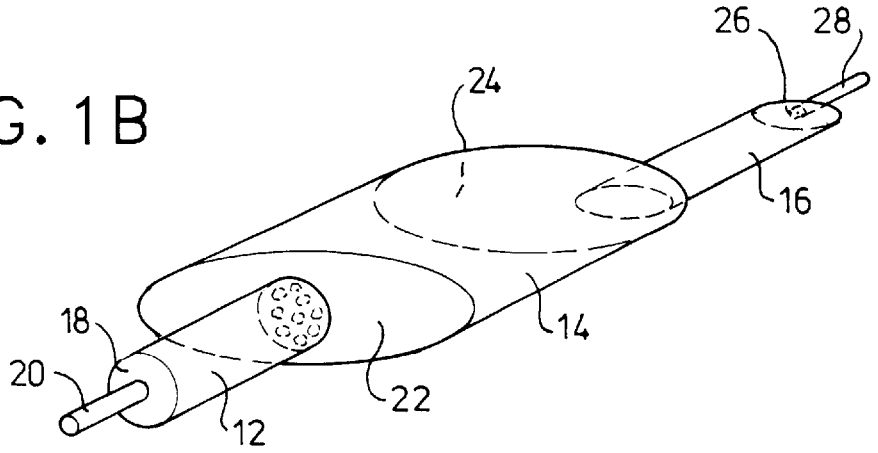

FIGS. 1A and 1B show an exhaust system in which the invention may advantageously be employed. FIG. 1A shows a cross-section of the exhaust system and FIG. 1B shows a perspective view of the exhaust system. The exhaust system is provided with three tubular sections 12, 14 and 16. In the example shown, the tubular section 12 is of circular-cylindrical design and is closed off at the front side by a wall 18, into which the inlet pipe 20 opens. This inlet pipe 20 runs, for example, to the manifold of a multi-cylinder internal-combustion engine. (The pipe 20 could also be an exhaust pipe).

The second tubular section 14 is in this example designed as a cylinder with a flattened cross-section, for example an elliptical or similar cross-section. This cylinder is closed off at the front side by means of a transverse plate 22 and is closed off at the rear side by means of a transverse plate 24.

In this example, the third tubular section 16 is also designed as a flattened, unround cylinder which is attached at the front side to the transverse plate 24, and at the rear side is closed off by means of a transverse plate 26, into which the pipe 28 opens.

Within the context of the invention, all the tubular sections may have any desired cross-sectional shape. Both round and unround cross-sections are possible. In view of the space available on the underside of a vehicle, the flattened shapes will often be particularly preferred. Since, within the context of the invention, use is made of seamed roll joints, it is preferable for the cylinder to have a smooth shape without corners or the like.

The first tubular section 12 adjoins the second tubular section 14 approximately in the center. However, such positioning is in no way necessary, and to illustrate this fact in FIG. 1A the third tube section 16 is clearly connected asymmetrically to the second tube section 14.

If desired, it is possible to provide perforated closure walls, such as for example the wall 30 shown in FIG. 1A between the first tube section 12 and the second tube section 14, at the location of the transitions between the various tube sections. The perforated wall 30 may be provided with one or more openings, in order to allow gas to flow from the tube section 12 to the tube section 14. The function of a partition of this nature may also be assumed by the internal parts which are arranged in the tube sections. It is assumed that design properties of this nature are known to a person skilled in the art in this field and do not require further explanation.

As has already been stated, in a practical embodiment, the inlet pipe 20 could form part of the manifold of a multi-cylinder internal-combustion engine. The first tubular section 12 may, for example, contain the catalytic converter, and the second tube section 14 may be provided with internal parts such that this tube section forms a first silencer, and the third tube section 16 may also be provided with internal parts, in such a manner that it forms a second silencer. The exhaust pipe 28 is then used to guide the exhaust gases outwards beneath the vehicle.

Within the context of the invention, the various joints between tube sections and transverse plates are formed by means of seamed roll joints. The steps carried out in this method will be discussed in more detail with reference to FIGS. 2A–2D, 3A–3D and 4A–4D.

FIGS. 2A–2D show a first embodiment of a method according to the invention, in which the joints are produced between a first tube section with a relatively small cross-section (for example 12 in FIG. 1A) and a second tube section with a relatively large cross-section (for example 14 in FIG. 1A).

Figure 2A:
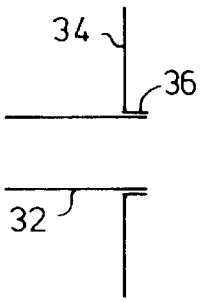
FIGS. 2A–2D show a number of phases during the execution of a method according to the invention.
Figure 2B:
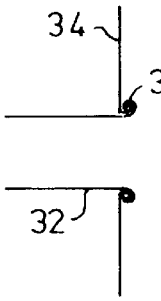
Figure 2C:
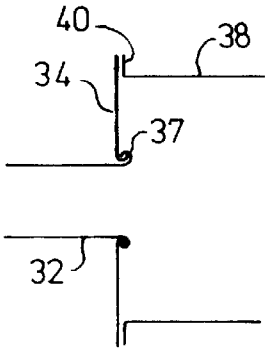

In FIG. 2A, the tube section with a relatively small diameter is indicated by 32. In the step illustrated in FIG. 2A, a transverse plate 34 with an opening is provided with a flanged edge 36 which is pushed onto the end of the section 32. Then, with the aid of a suitable tool, a seamed roll joint is formed, the result of which is illustrated diagrammatically in FIG. 2B. As a third step, the tubular section with a relatively large cross-section, which in FIG. 2C is indicated by 38, is provided with a flanged edge 40 positioned against the transverse plate 34. With the aid of a suitable tool, the seamed roll joint 41 is then realized.

Figure 2D:
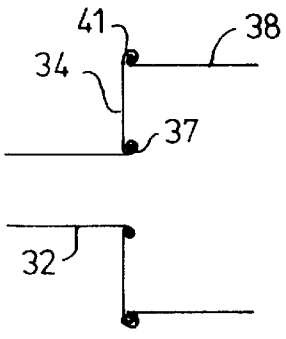

FIGS. 3A–3D show a number of steps for a variant of the method according to the invention in which, as in FIG. 2D, a tube section with a relatively large cross-section is mounted on the end of a tube section with a relatively small diameter. In this embodiment, the tube section with a relatively large diameter 38' is provided with a flanged edge 40'. A flanged edge 36' is also formed along the edge of the opening in the transverse plate 34'. The two components are then positioned against one another and, with the aid of a suitable seam rolling tool, the seamed roll joint 41' is realized. This results in the situation shown in FIG. 3B.

Figure 3A:
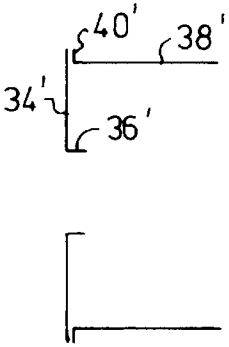
FIGS. 3A–3D show a number of phases during the execution of another embodiment of the method according to the invention.
Figure 3B:
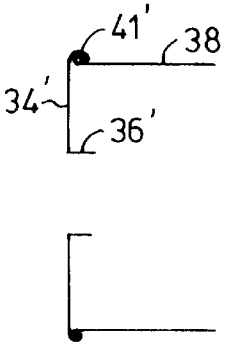
Figure 3C:
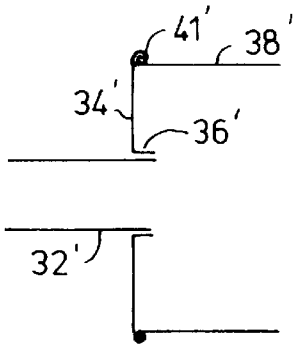
Figure 3D:
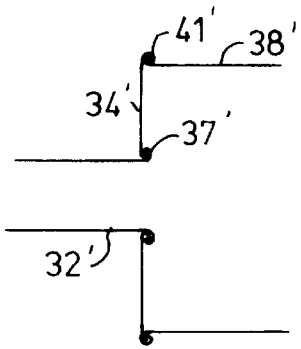

As shown in FIG. 3C, the part product obtained in this way is pushed onto the end of the tube section 32' with a smaller cross-section. As a final step in the method, the seamed roll joint 37' is formed with the aid of a suitable seam rolling tool.

Figure 4A:
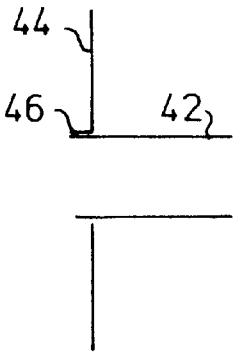
FIGS. 4A–4D show a number of phases during the execution of yet another embodiment of a method according to the invention.
Figure 4B:
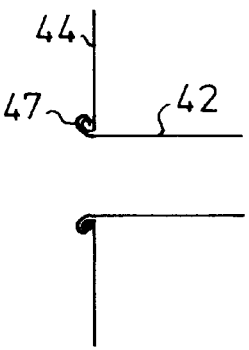
Figure 4C:
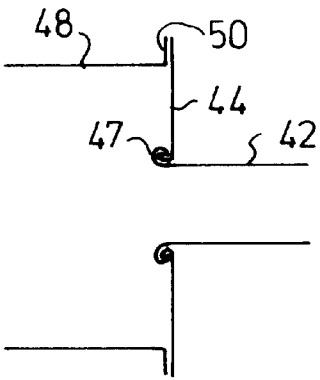
Figure 4D:
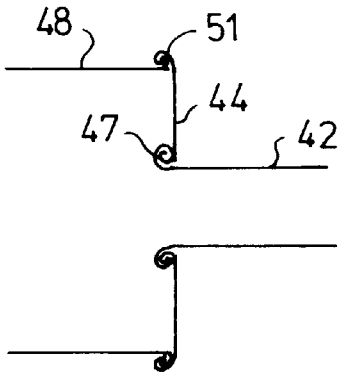

The way in which a tube section with a relatively small cross-section can be mounted on the end of a tube section with a relatively large cross-section is illustrated in FIGS. 4A–4D. To start with, the edge around the opening in the transverse plate 44 is provided with a flanged edge, and the plate 44 which has been preformed in this way is pushed onto the end of the tube section with a smaller cross-section 42. From the situation shown in FIG. 4A, the step shown in FIG. 4B is reached by making use of a suitable seam rolling tool, with which the seamed roll joint 47 is formed.

As the next step, the tubular section 48 with a larger cross-section is provided with a flanged edge 50 and is positioned against the transverse plate 44. This results in the situation shown in FIG. 4C. By making use of a suitable seam rolling tool, the rolled seam 51 is produced, resulting in the situation shown in FIG. 4D. The method of FIGS. 4A–4D can be used, for example, to connect the third tube section 16 in FIG. 1A to the second tube section 14 via the transverse plate 24.

It will be clear that during the manufacture of an exhaust system as shown in FIGS. 1A–1B, the various tube sections must, in each case, be provided with the internal parts fitting inside them at the correct moments. When carrying out the method in accordance with FIGS. 2A–2D and 3A–3D, it is generally still possible to slide the internal parts into the tubular section with a relatively small diameter from the right-hand side of the figure at the end of the entire procedure. In the case of the method in accordance with FIGS. 4A–14B, it is necessary for the internal parts to be introduced into the tube section 48 with a larger diameter between the steps illustrated in FIGS. 4B and 4C, since this entire tube section 48 is closed off after the step illustrated in FIG. 4D has been carried out.

Figure 5A:
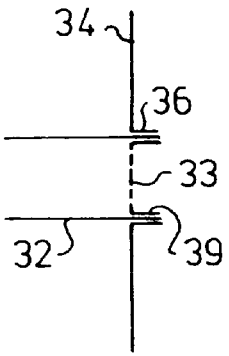
FIGS. 5A–5C show a number of phases in a variant of a method as discussed with reference to FIG. 2.
Figure 5B:
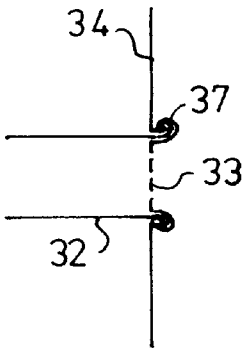
Figure 5C:
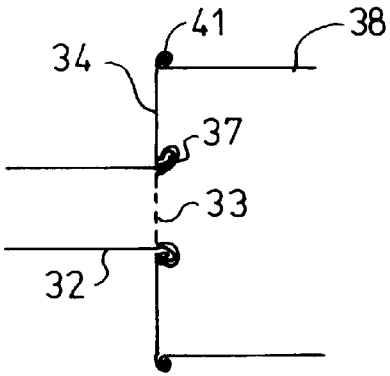

As has already been noted with reference to FIG. 1A, it is possible to arrange perforated closure plates between the various tube sections, with the result that a clear boundary is obtained between the internal chambers of the tube sections. FIG. 5A shows how a closure plate of this kind can be fitted in place without changing the seamed rolling process. By way of example, FIG. 5A illustrates the situation which corresponds to FIG. 2A, but with a perforated closure plate 33 provided with a flanged edge 39 having been pushed into the tube 32 prior to the seamed rolling process. Then, the rolled seam 37 is again formed, resulting in the situation shown in FIG. 5B, which corresponds to the situation shown in FIG. 2B. As can clearly be seen from FIG. 5B, the seamed rolling process produces a joint not only between the transverse plate 34 and the tube section 32 but also between the closure plate 39 and the tube section 32. The three components are joined to one another using one seamed rolling operation. If the tube section 38 with a larger diameter is then put in place in the manner which has already been described with reference to FIG. 2A–2D and is fixed using seamed roll joints, the result is the end situation shown in FIG. 5C, which is comparable to that shown in FIG. 2D, except that the perforated closure plate 33 is installed in FIG. 5C.

It will be clear to a person skilled in the art without further illustration that perforated closure plates can be fitted in the same way in the methods illustrated in FIGS. 3A–3D and 4A–4D.

In general, it is possible to choose between a number of possibilities for forming the seamed roll joints. By way of example, FIGS. 6A–6D diagrammatically depict two possibilities of attaching a transverse plate to a relatively thin tube.

In FIG. 6A, it is assumed that the tube 50 is not subjected to any preparatory treatment, and that the transverse plate 52 is provided with a flanged edge 54 in such a manner that the tube 50 fits precisely in the opening which is delimited by the flange 54. Then, with the aid of a block 56 for producing seamed roll joints, the seamed roll joint is realized, resulting in the joint which is diagrammatically illustrated in FIG. 6B.

In FIG. 6C, it is assumed that the transverse plate 52 is not subjected to any preparatory treatment, and that the tube 50 is provided with a flanged edge 58 in such a manner that the flanged edge 58 of the tube 50 fits precisely against the opening in the transverse plate 52. Then, with the aid of a block 56 for producing seamed roll joints, the seamed roll joint is realized, resulting in the joint which is diagrammatically illustrated in FIG. 6D.

I claim:

1. An exhaust system comprising:

at least two silencers connected in series, said at least two silencers each having a tubular section with two ends, each of said tubular sections comprising internal parts designed and adapted for sound dampening and passing of exhaust gases;

at least one transverse plate for connecting two of said at least two silencers, said two of said at least two silencers comprising a first silencer with a cross-section smaller than a cross-section of a second silencer, said at least one transverse plate having an opening for receiving one of said two ends of said first silencer, said at least one transverse plate having a cross-section defined by a perimeter with external dimensions corresponding to one of said two ends of said second silencer, and said first silencer and said second silencer each being connected to said at least one transverse plate by seamed roll joints.

2. The exhaust system of claim 1, wherein at least one of said tubular sections has internal parts comprising a catalytic converter.

3. The exhaust system of claim 1, further comprising at least one perforated closure plate disposed in and filling said opening, said perforated closure plate having external dimensions corresponding to the size of said opening, and said perforated closure plate being connected by seamed roll joints to an end of one of said at least two silencers and to said opening in said at least one transverse plate.

4. The exhaust system of claim 1, wherein one of said opening and said first silencer comprises a flange.

5. The exhaust system of claim 1, wherein one of said perimeter and said second silencer comprises a flange.

6. The exhaust system of claim 3, wherein said perforated closure plate comprises a flange.

7. An exhaust system comprising:

at least three silencers connected in series, said at least three silencers each having a tubular section with two ends, each of said tubular sections comprising internal parts for sound dampening through which exhaust gases must pass; and at least two transverse plates for connecting three of said at least three silencers, said three of said at least three silencers comprising a first silencer with a cross-section smaller than a cross-section of a second silencer, and a third silencer having a cross-section different than said cross-section of said first silencer and smaller than said cross-section of said second silencer, said at least two transverse plates comprising a first transverse plate and a second transverse plate, said first transverse plate having a first opening for receiving one of said two ends of said first silencer, said first transverse plate having a cross-section with external dimensions corresponding to one of said two ends of said second silencer, said first transverse plate being connected to an end of said first silencer and to an end of said second silencer by seamed roll joints, said second transverse plate having a cross-section with external dimensions corresponding to a different one of said two ends of said second silencer, and said second transverse plate having a second opening for receiving one of said two ends of said third silencer, and said second transverse plate being connected to said different one of said two ends of said second silencer and to said one of said two ends of said third silencer by seamed roll joints.

8. A method for producing an exhaust system, comprising the steps of:

providing a first silencer having a tubular section;

providing a second silencer having a tubular section larger in cross-section than the first silencer;

providing a transverse plate with exterior dimensions corresponding to the cross-section of the second silencer, and having a flanged opening corresponding in size to the cross-section of the first silencer;

placing an end of the first silencer in the flanged opening; forming a seamed roll joint to attach the first silencer to the transverse plate;

placing internal parts in the tubular section of at least one of the first silencer and the second silencer; and forming a seamed roll joint to attach the second silencer to the outer perimeter of the transverse plate.

9. The method of claim 8, further comprising the steps of:

placing a flanged perforated closure plate over the flanged opening in the transverse plate prior to attaching the first silencer to the transverse plate; and forming a seamed roll joint to attach the first silencer and the flanged perforated closure plate to the transverse plate flange.

10. The method of claim 8, wherein the step of forming a seamed roll joint to attach the second silencer to the outer perimeter of the transverse plate is performed before the step of forming a seamed roll joint to attach the first silencer to the transverse plate flange.

11. The method of claim 10, further comprising the steps of:

placing a flanged perforated closure plate over the flanged opening in the transverse plate prior to attaching the first silencer to the transverse plate; and forming a seamed roll joint to attach the first silencer and the flanged perforated closure plate to the transverse plate flange by using the seam rolling tool.

12. The method of claim 8, wherein the step of placing internal parts places a sound dampening assembly in the tubular section of at least one of the first silencer and the second silencer.

13. The method of claim 8, wherein the step of placing internal parts places a catalytic converter in the tubular section of at least one of the first silencer and the second silencer.

* * * * *